US007044840B2

(12) United States Patent
Yoshimi et al.

(10) Patent No.: US 7,044,840 B2
(45) Date of Patent: May 16, 2006

(54) GRINDING METHOD AND GRINDING MACHINE

(75) Inventors: Takayuki Yoshimi, Toyohashi (JP); Hiroshi Morita, Hoi-gun (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 127 days.

(21) Appl. No.: 10/633,665

(22) Filed: Aug. 5, 2003

(65) Prior Publication Data

US 2004/0029510 A1 Feb. 12, 2004

(30) Foreign Application Priority Data

Aug. 7, 2002 (JP) ..... 2002-230534
Aug. 7, 2002 (JP) ..... 2002-230536

(51) Int. Cl.
*B24B 5/04* (2006.01)

(52) U.S. Cl. ..... 451/53; 451/56; 451/72; 451/285; 451/442

(58) Field of Classification Search ..... 451/7, 451/21, 41, 53, 56, 72, 450, 285–290, 442, 451/448, 242, 243, 28, 449
See application file for complete search history.

(56) References Cited

U.S. PATENT DOCUMENTS 6,083,084 A * 7/2000 Yokogawa et al. ..... 451/53
6,123,606 A * 9/2000 Hill et al. ..... 451/53
6,273,795 B1 * 8/2001 Hatamoto et al. ..... 451/56
6,328,636 B1 * 12/2001 Yoshimi et al. ..... 451/56
6,375,558 B1 4/2002 Baratta
6,454,636 B1 * 9/2002 Iwabuchi ..... 451/53
6,626,743 B1 * 9/2003 Boyd ..... 451/56
6,648,738 B1 * 11/2003 Eto et al. ..... 451/254
6,669,532 B1 * 12/2003 Mukai et al. ..... 451/7
2003/0236059 A1 12/2003 Morita
2004/0005844 A1 1/2004 Morita et al.

FOREIGN PATENT DOCUMENTS

JP 59-152063 8/1984

OTHER PUBLICATIONS

V.A. Vasil 'EV, Soviet Engineering Research, vol. 8, No. 8, pp. 132-133, XP-000142467, "A New Grinding Rluid Delivery Device", 1988.

* cited by examiner

*Primary Examiner*—Lee D. Wilson
*Assistant Examiner*—Anthony Ojini
(74) *Attorney, Agent, or Firm*—Oblon, Spivak, McClelland, Maier & Neustadt, P.C.

(57) ABSTRACT

In a grinding machine grinding a workpiece W by a grinding wheel G to supply coolant to one of a grinding point P or the workpiece W by way of a relative movement between the grinding wheel W rotatably supported on a wheel slide 11 and the workpiece W supported by a work support device 17, air layer 36 flowing on a circumferential surface Gc of said grinding wheel G by blowing hydraulic jet 35 transversally from one side to the other side of the grinding wheel G along the circumferential surface Gc at an upper stream position of a rotational direction of the grinding wheel G from the grinding point P. Mist of coolant blown by the hydraulic jet 35 through a recovering port 37, 43, 53 mounted on a wheel guard 20 covering a part of the grinding wheel G.

13 Claims, 6 Drawing Sheets

(a) (b)

GRINDING METHOD AND GRINDING MACHINE

INCORPORATION BY REFERENCE

The present application claims priority under 35 U.S.C. §119 to Japanese Patent Applications No. 2002-230534, filed on Aug. 7, 2002 and No. 2002-230536, filed on Aug. 7, 2002. The contents of these applications are incorporated herein by reference in their entirety.

BACKGROUND OF THE INVENTION

1. Field of the Invention

The present invention relates to a grinding method of and a grinding machine for grinding a workpiece with a rotatable grinding wheel wherein coolant is reliably supplied to a grinding point by cutting off air layer flowing on a circumferential surface of the grinding wheel.

2. Description of the Related Art

It is typically known for a grinding machine to grind a workpiece by a grinding wheel rotated at high speed. FIG. 1 shows a method of supplying a high pressure of coolant, in which a nozzle 60 supplies highly pressurized coolant at high speed to a grinding point grinding the workpiece by the grinding wheel G in order to cut off air layer flowing on a circumferential surface of the grinding wheel G. FIG. 2 shows a method of supplying a coolant perpendicularly, in which a supply port of a coolant nozzle 61 is faced to an circumferential surface of a grinding wheel G to supply coolant perpendicularly thereto. And also, it is typically known for an ecology grinding to supply atomized lubrication oil, which is mixed lubrication oil with compressed air supplied from an air source, from a nozzle to a grinding point and to supply a small amount of coolant to a workpiece for cooling the workpiece.

The high pressure supplying method of coolant or the perpendicular method of coolant of the typically known grinding machine can not reliably and efficiently cut off said air layer flowing on the circumferential surface of the grinding wheel. And also, in the high pressure supplying method of coolant or the perpendicular method of coolant of the typically known grinding machine, since coolant is compulsorily supplied to reach the circumferential surface against air layer flowing on the circumferential surface, it therefore needs inevitably high pressure and large volume of coolant. Where the high pressure or the large volume coolant is used, it needs not only a huge cost maintaining clean in coolant but also make an environmental problem in a waste process of the large volume of coolant. And also, in the ecology grinding of the typically known grinding machine, stream of supplied coolant is week because of the small amount of coolant so that it is difficult for supplying coolant reliably with a disturbance by air layer flowing on the circumferential surface of the grinding wheel.

The applicant filed the patent application to cut off air layer flowing on a circumferential surface of a grinding wheel at an upper stream position of a rotational direction of the grinding wheel from a grinding point. In a grinding machine grinding a workpiece by the grinding wheel rotated at high speed of this application, air jet is blown transversally from one side to the other side of the grinding wheel along the circumferential surface at the upper stream position of the rotational direction of the grinding wheel from the grinding point in order to cut off said air layer flowing on the circumferential surface of the grinding wheel reliably to supply coolant to the grinding point. When said air jet is blown transversally along the circumferential surface from said one side to the other side of the grinding wheel, coolant flown with said air jet on the circumferential surface of the grinding wheel from the grinding point is blown by said air jet so that mist of coolant is scattered to atmosphere around over the grinding machine to cause a bad environment in a factory.

SUMMARY OF THE INVENTION

In view of the previously mentioned circumstances, it is an object of the present invention to provide a grinding method or a grinding machine preventing mist of coolant from scattering with air jet to atmosphere.

It is second object of the present invention to provide a grinding method or a grinding machine reliably preventing mist of coolant from scattering with air jet to atmosphere by recovering mist of coolant by means of an absorbing equipment, a separator and a discharge port.

It is third object of the present invention to provide a grinding method or a grinding machine reliably preventing mist of coolant from scattering with air jet to atmosphere by a fixed position of a recovering port.

It is fourth object of the present invention to provide a grinding method or a grinding machine reliably and efficiently preventing mist of coolant from scattering with air jet to atmosphere by facing a recovering port to mist of jet.

It is fifth object of the present invention to provide a grinding machine reliably and efficiently preventing mist of coolant from scattering with air jet to atmosphere by shielding almost all of a grinding wheel.

It is another object of the present invention to provide a grinding machine reliably and efficiently preventing mist of coolant from scattering with air jet to atmosphere by a unitary construction of supplying coolant and air jet and recovering them.

It is other object of the present invention to provide a grinding machine reliably and efficiently preventing mist of coolant from scattering with air jet to atmosphere by reducing a volume of coolant with an assistance of lubrication oil.

In order to achieve the above and other objects, the present invention provides a grinding method of or a grinding machine for grinding a workpiece with a rotatable grinding wheel by the way of cutting off air layer flowing on a circumferential surface of the grinding wheel by blowing hydraulic jet transversally from one side to the other side of the grinding wheel along the circumferential surface at an upper stream position of a rotational direction of the grinding wheel from the grinding point, and by the way of collecting mist of coolant blown by the hydraulic jet through a recovering port mounted on a wheel guard covering a part of said grinding wheel. Said hydraulic jet blown transversally from one side to the other side of the grinding wheel along the circumferential surface at the upper stream position of the rotational direction of the grinding wheel from the grinding point can cut off air layer flowing on the circumferential surface of the grinding wheel. Mist of coolant mixed hydraulic jet with coolant is flowing within a wheel guard and collected by a recovering port. Thereby, coolant flowing with air layer is reliably prevented from being scattered from the wheel guard to atmosphere in the stage of mist.

Second aspect of the present invention is a grinding method or a grinding machine absorbing mist of coolant by an absorbing equipment, separating mist of coolant by a separator and discharging hydraulic coolant from a wheel guard. The absorbing equipment is connected to the recovering port. Thereby, mist of coolant mixed hydraulic jet with coolant is absorbed by the absorbing equipment from the recovering port so that it is not scattered to atmosphere. The separator is connected between the recovering port and the absorbing equipment to separate said mist of said coolant from air jet. Thereby the mist of coolant absorbed by the absorbing equipment is separated from air jet so that the mist of coolant can separated from air to be prevented from scattering to atmosphere. The discharge port is mounted on a lower portion of said wheel guard and discharging hydraulic coolant from said wheel guard. Thereby, a part of mist of coolant is changed to hydraulic coolant stayed at the bottom of the wheel guard and said hydraulic coolant is discharged from the discharge port. So that coolant flowing with air layer is reliably prevented from being scattered from the wheel guard to atmosphere in the stage of mist by the way of the absorbing equipment, the separator and the discharge port.

Third aspect of the present invention is that said recovering port is formed on an upper portion of a back area of the wheel guard. Said mist of coolant is flowing from a point blown by hydraulic jet to be scattered within the wheel guard and is mainly flown by the rotation of the grinding wheel to the back area so that the recovering port fixed at the back area of the wheel guard can reliably collect mist of coolant. Thereby, coolant flowing with air layer is reliably prevented from being scattered from the wheel guard to atmosphere in the stage of mist by the way of the fixed position of the recovering port.

Fourth aspect of the present invention is that said recovering port is mounted on the wheel guard at the other side of the grinding wheel to face to said blown hydraulic jet. Mist of coolant is immediately corrected and recovered by the recovering port just after cutting off air layer so that coolant flowing with air layer is reliably and efficiently prevented from being scattered from the wheel guard to atmosphere in the stage of mist by the way of facing the recovering port to mist of jet.

Fifth aspect of the present invention is that shield means are provided in the wheel guard. One shield means are a baffle plate mounted on the wheel guard and facing to the grinding wheel with a small clearance at an upper stream position of the rotational direction of the grinding wheel from a point of the hydraulic jet. Thereby, since air layer is cut off by the baffle plate first and then cut off by hydraulic jet at second time in order to be reliably cut off so that coolant is reliably supplied to grinding point without disturbance by air layer flowing on the circumferential surface of the grinding wheel. Besides, the baffle plate has both elongated side portions and both side surfaces of the side portions also cut off air layer flowing on a side surface of the grinding wheel. Another shield means are a guard body and a cover. The guard body shields one side surface of the grinding wheel at a side of a wheel slide and the circumferential surface of said grinding wheel, and the cover shields an opening portion of the grinding wheel at a side of the other side of the grinding wheel. A front wall of the guard body and a front wall of the cover cooperate to form a slit when said cover is pivoted to close the opening portion. Thereby, the wheel guard is an almost sealed construction to shield almost all of the grinding wheel by the guard body and the cover to project only a part of a front portion of the grinding wheel around the grinding point from the wheel guard through the slit formed in a front portion of the wheel guard so that, since only the part of the front portion of the grinding wheel projects through the slit formed on a front wall of the wheel guard, mist of coolant can be almost shielded within the wheel guard without scattering to atmosphere. And also thereby, the cover can be easily pivoted to open the opening portion in order to change the grinding wheel.

Another aspect of the present invention is that the grinding machine provides a coolant supplying device being a unitary construction of a coolant supplying portion, a hydraulic jet supplying portion and a hydraulic jet recovering portion. Since relative position of a coolant nozzle of the coolant supplying portion, a hydraulic jet nozzle of the hydraulic jet supplying portion and a recovering port member of the hydraulic jet recovering portion are fixed at suitable and stable relation so that it can be possible that supplying coolant and air jet and recovering them are performed correctly and constantly in a stable condition.

Other aspect of the present invention is that the grinding machine provides an ecology grinding equipment. The ecology grinding equipment consists of the coolant nozzle facing directly to the workpiece for supplying a small amount of said coolant to cool the workpiece, a compressed air nozzle opening to the circumferential surface of the grinding wheel at an upper stream of the rotational direction of the grinding wheel from the grinding point, and a nozzle mounted on the compressed air nozzle and connecting to a lubrication tank to drop lubrication oil to the compressed air nozzle in order to lubricate the grinding wheel at the grinding point. Thereby, air layer flowing on the circumferential surface is cut off by hydraulic jet so that the atomized lubrication oil is stuck with the circumferential surface efficiently, therefore, coolant flowing with air layer is reliably prevented from being scattered from the wheel guard to atmosphere in the stage of mist by the way of dramatically reducing a total volume of coolant to almost 1/100 of the conventional coolant volume with an assistance of lubrication oil.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
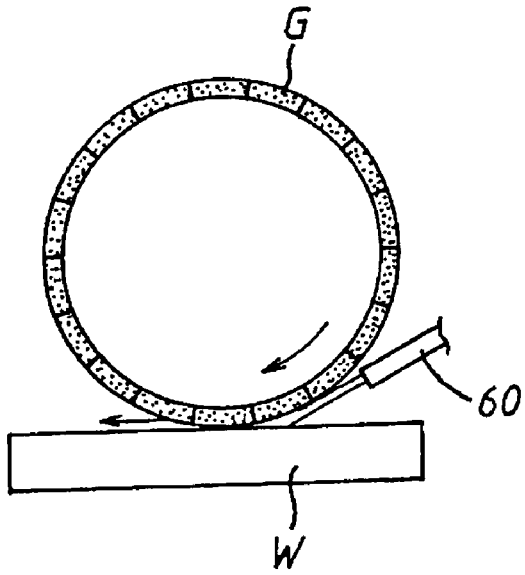
FIG. 1 PRIOR ART
FIG. 1 is a high pressure supplying method of coolant in a related art.
Figure 2:
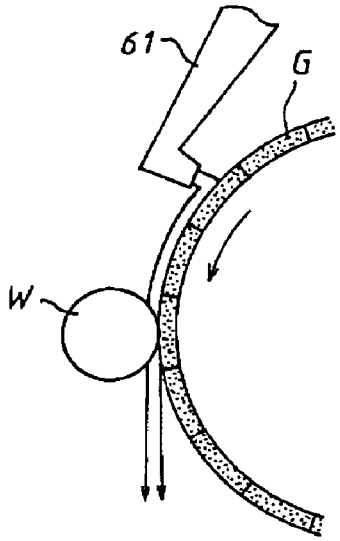
FIG. 2 PRIOR ART
FIG. 2 is a perpendicular supplying method of coolant in a related art.
Figure 3:
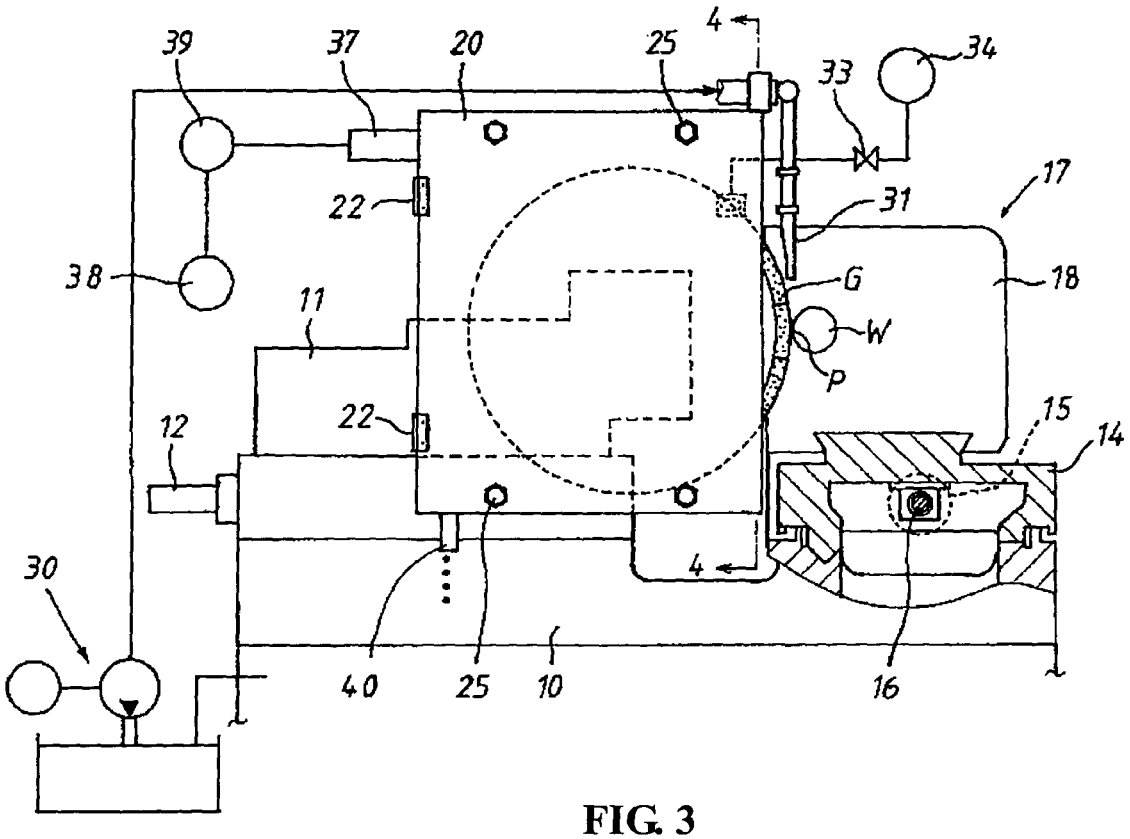
FIG. 3 is a side view of a grinding machine with an air cut device to cut off air layer flowing on a circumferential surface of a grinding wheel in first embodiment of the present invention.
Figure 4:
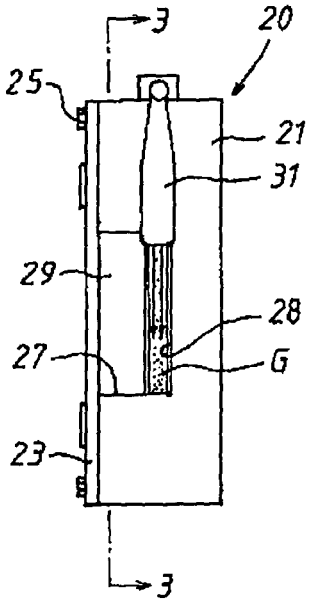
FIG. 4 is a front view of the air cut device.

A preferred first embodiment of a grinding method and a grinding machine according to the present invention will be described referring to FIG. 3 to FIG. 7. A wheel slide 11 is slidably mounted on a bed 10 to slide toward to and apart from a workpiece W in an X axis direction through a ball screw mechanism by a servo motor 12. On the wheel slide 11 is rotatably mounted a wheel spindle 13 with a grinding wheel G at an end thereof and the grinding wheel G is rotated by a motor. The grinding wheel G consists of a disk body of a metal composing of an iron or an aluminum and plural abrasive chips bonded on a peripheral surface of the disk body. A table 14 is slidably mounted on the bed 10 to be moved in a Y axis direction perpendicular to the X axis direction through a ball screw mechanism 16 by a servo motor 15. On the table 14 are mounted an unillustrated head stock and a tail stock 18 constructed a workpiece supporter 17 and the workpiece W is supported by both centers of the head stock and the tail stock 18 to be rotated.

Figure 7:
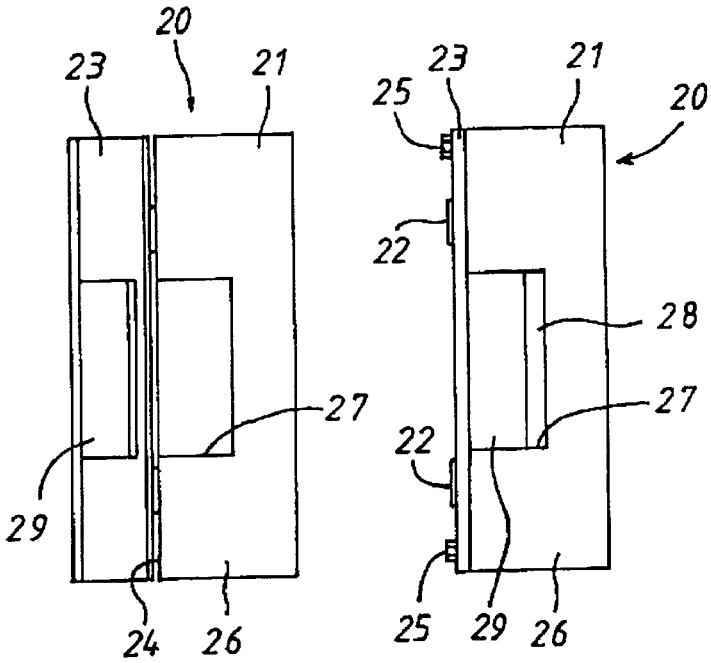
FIG. 7 is a diagram showing a wheel guard.

On the wheel slide 11 is fixed a wheel guard 20 covering the grinding wheel G. The wheel guard 20 consists of a guard body 21 and a cover 23, the guard body 21 shields one side surface Ga and a circumferential grinding surface Gc of the grinding wheel G at a side of the wheel slide 11. The cover 23 is pivoted on a hinge 22 at the back portion thereof to shield an opening portion 24 of the guard body 21 at the other side surface Gb of the grinding wheel G to be clamped by bolts 25 or other suitable clamping method such as lever clamping mechanism and so on. When the grinding wheel G is changed to new one, the bolts 25 are un-screwed and the cover 23 is moved pivotally on the hinge 22 to release the opening portion 24. Referring to FIG. 7(*a*), a rectangular notch 27 is horizontally formed from the opening portion 24 to approximately a center on a front wall 26 of the guard body 21. On a front portion of the cover, a shield projection 29 is mounted to cover the notch 27 from the opening portion 24 to a part length of the notch 27 to remain a slit 28 projecting only a front portion Ge of the grinding wheel G from the wheel guard 20. Therefore, referring to FIG. 7(*b*), when the cover 23 is fixed to shield the opening portion 24, the slit 28 is formed by a cooperation of the front wall 26 and the shield projection 29.

Figure 5:
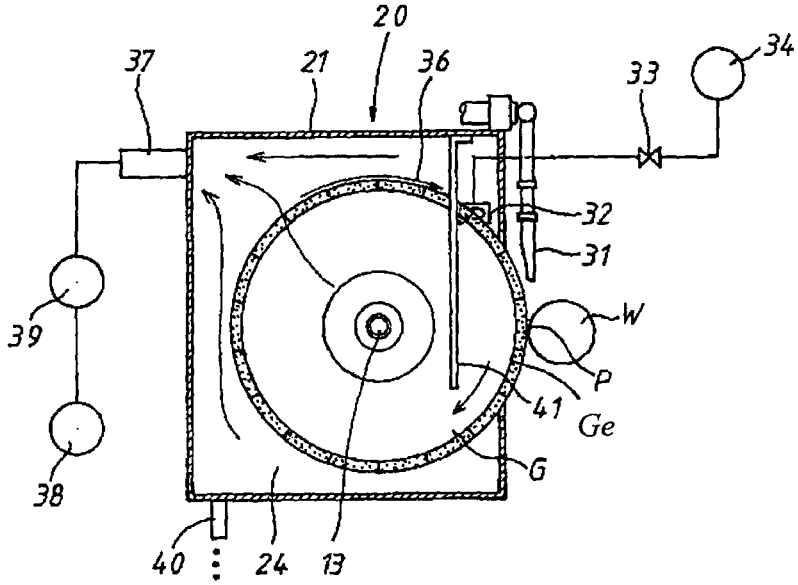
FIG. 5 is a 3—3 sectional view in FIG. 4.
Figure 6:
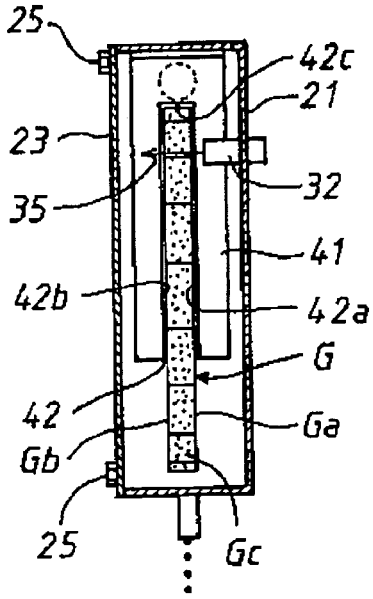
FIG. 6 PRIOR ART
FIG. 6 is a 4—4 sectional view in FIG. 1.

On the upper portion of the guard body 21 a coolant nozzle 31 of a coolant supplying device 30 is mounted to supply coolant to at least one of a grinding point P grinding the workpiece W and a outer peripheral surface of the workpiece W. Referring to FIG. 5 and FIG. 6, in the wheel guard 20 is attached an air jet nozzle 32 having an horizontal opening toward an edge of the one side surface Ga of the grinding wheel G at an upper stream position of a wheel rotational direction from the grinding point P. The air jet nozzle 32 is connected to a pressurized air source 34 of a factory air and so on through a switch valve 33 driven magnetically, thereby, air jet 35 is blown transversally from the one side surface Ga to the other side surface Gb along the grinding surface Gc of the grinding wheel G to cut off air layer 36 flowing on the circumferential grinding surface Gc of the grinding wheel G. A cross section of the air jet nozzle 32 is formed as an ellipse to a radial direction of the grinding wheel G to supply air jet 35 certainly to the edge of the grinding wheel G when a diameter of the grinding wheel G is reduced by a dressing. An outlet recovering port 37 is formed on an upper portion of a back area of the wheel guard 20 to be connected to an absorbing equipment 38 such as a dust collector. A separator 39 is connected between the outlet recovering port 37 and the absorbing equipment 38 to separate atomized coolant in air jet 35 and the separator 39 can be a well known centrifugal separator. A discharge port 40 is mounted on a lower portion of the wheel guard 20 to discharge hydraulic coolant stayed in. In the wheel guard 20, a baffle plate 41 is fixed to make a small clearance against the circumferential grinding surface Gc or both each side surface Ga, Gb at the upper stream position of the rotational direction of the grinding wheel G from a set position of the air jet nozzle 32. The baffle plate 41 has an open groove 42 from a bottom upwardly referring to FIG. 6 and both each side surface 42*a*, 42*b* and a blind end 42*c* of the opening groove 42 are faced to both each side surface Ga, Gb and the circumferential grinding surface Gc of the grinding wheel G with said small clearance. A lowest end of the baffle plate 41 is extended to the same or lower position than the grinding point P.

The operation of the above-constructed first embodiment of the present invention will be explained hereinafter.

The workpiece W is rotated during supported by both centers of the head stock and the tail stock 18. The wheel slide 11 is advanced by the servo motor 12 to grind the workpiece W by the grinding wheel G rotated at high speed in the stage that coolant is supplied to the grinding point P through the coolant nozzle 31. Air is supplied through the opened switch valve 33 from the pressurized air source 34 to the air jet nozzle 32 and thereby air jet 35 is blown from a side to the grinding surface Gc at the upper stream position of the rotational direction of the grinding wheel G across the grinding surface Gc from one side surface Ga to the other side surface Gb. Air layer 36 flowing on the circumferential surface Gc of the grinding wheel G is cut off by said air jet 35. Therefore, almost all of air layer 35 can not reach to the grinding point P so that coolant is reliably supplied to the grinding point P in keeping contact with the circumferential grinding surface Gc without being disturbed by air layer 36.

A part of coolant is led into the wheel guard 20 in keeping contact with the circumferential grinding surface Gc after passing the grinding point P and coolant reaches to air jet 35 to be blown thereby to become mist scattered in the wheel guard 20. A part of mist is changed to hydraulic coolant stayed at the bottom of the wheel guard 20 and hydraulic coolant is discharged from the discharge port 40. Air including remaining atomized coolant is absorbed through the outlet recovering port 37 by the absorbing equipment 38 to the separator 39. Atomized coolant is flowed into the separator 39 in tangential direction to be whirled at high speed and to be separated hydraulic coolant from air. Separated hydraulic coolant is recovered to the coolant supplying device 30 through a tapered bottom surface and a discharged port of the separator 39. Thereby, coolant flowing with air layer 36 is reliably prevented from being scattered from the wheel guard 20 to atmosphere in the stage of mist by the way of the outlet recovering port 37 formed on the upper portion of the back area of the wheel guard 20 and the discharge port 40 formed on the bottom portion of the wheel guard 20.

Because air layer 36 flowing on the circumferential surface is first cut off to be reduced by the baffle plate 41 positioned at the upper stream position of the wheel rotational direction from the set position of the air jet nozzle 32, air jet 35 can reliably and efficiently cut off said reduced air layer 36 at second time so that coolant from the nozzle 31 can be reliably supplied to the grinding point P without disturbance by air layer 36. In detail, air layer 36 flowing on the circumferential surface Gc of the grinding wheel G is cut off to be reduced by the blind end 42*c* of the opening groove 42 of the shuffle plate 41 with the small clearance to the circumferential surface Gc and air layer flowing on the side surface Ga, Gb is cut off to be reduced by the side surface 42*a*, 42*b* of the opening groove 42 of the shuffle plate 41 with the small clearance to the side surface Ga, Gb in order to reduce air layer 36 flowing on the circumferential surface Gc more over, cutting off two times reliably and efficiently air layer 36 flowing on the circumferential surface Gc. Thereby, coolant flowing with air layer 36 is reliably prevented from being scattered from the wheel guard 20 to atmosphere in the stage of mist by the way of shielding almost all of the surface Ga, Gb and Gc of the grinding wheel G by the guard body 21, the cover 23, the shield projection 29 efficiently to collect all of mist of coolant.

Figure 8:
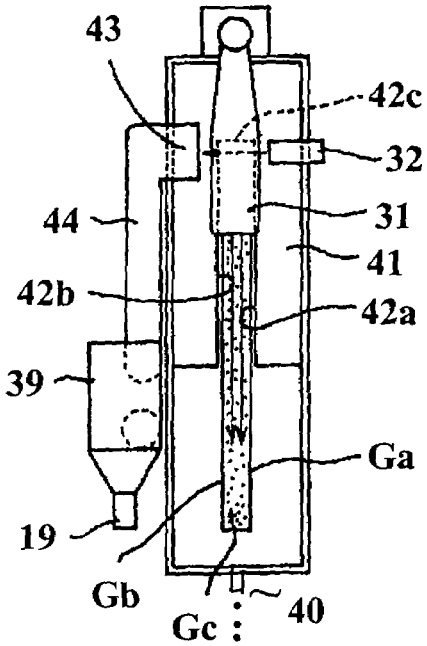
FIG. 8 is a front view of an air cut device to cut off air layer flowing on a circumferential surface of a grinding wheel in second embodiment of the present invention.
Figure 9:
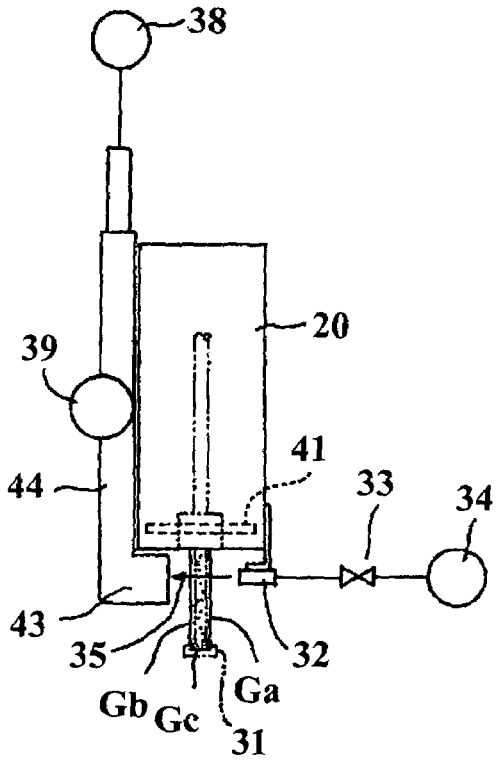
FIG. 9 is a plane view of the air cut device.

Next the second embodiment of the present invention will be now described hereinafter referring to FIG. 8 and FIG. 9. The same numeral to the first embodiment of the present invention shows the same construction so that an explanation of the same numeral is omitted. Only a difference of the second embodiment from the first embodiment is the position of the recovering port. A recovering port member 43 in the second embodiment is mounted on the wheel guard 20 at a side of the other side surface Gb of the grinding wheel G. The recovering port 43 is faced directly to the air jet nozzle 32 to receive air jet 35 with mist of coolant. A discharge passage 44 connecting to the recovering port 43 at a unit is connected to the absorbing equipment 38 through the separator 39.

The operation of the second embodiment is described hereinafter. Air jet 35 blown from the air jet nozzle 32 is mixed with coolant flowing with air layer 36 from the grinding point P to become mist of coolant. Mist of coolant is blown by air jet 35 to reach to the recovering port 43 with air jet 35 immediately after air jet 35 cuts off air layer 36 and is recovered by the absorbing equipment 38 through the separator 39. Mist of coolant is flowed into the separator 39 in tangential direction to be whirled at high speed and to be separated hydraulic coolant from air. Separated hydraulic coolant is recovered to the coolant supplying device 30 through a tapered bottom surface and a discharged port 19 of the separator 39. Therefore, mist of coolant is immediately corrected and recovered by the recovering port 43 just after cutting off air layer so that mist of coolant is reliably and efficiently prevented from being scattered from the wheel guard 20 to atmosphere.

Figure 10:
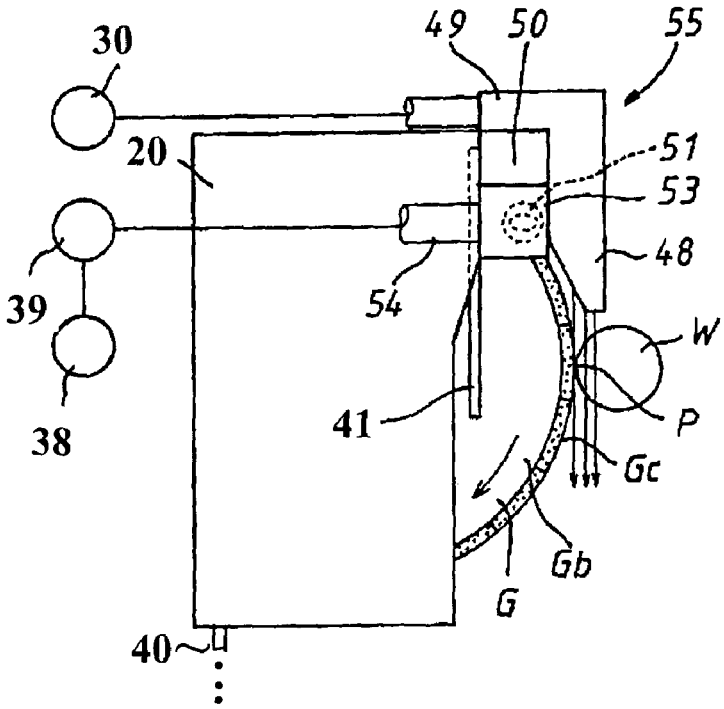
FIG. 10 is a side view of an air cut device to cut off air layer flowing on a circumferential surface of a grinding wheel in third embodiment of the present invention.
Figure 11:
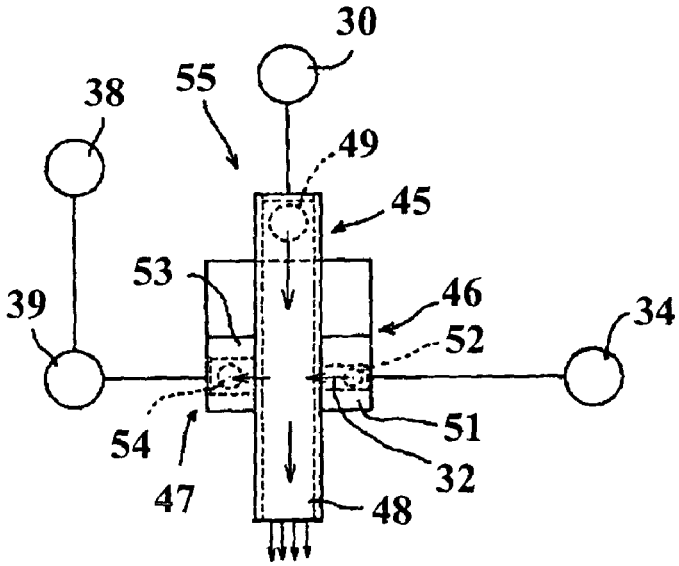
FIG. 11 is a plane view of the air cut device.

Next the third embodiment of the present invention will be now described hereinafter referring to FIG. 10 and FIG. 11. The same numeral to the first embodiment of the present invention shows the same construction so that an explanation of the same numeral is omitted. Only a difference of the third embodiment from the first embodiment is a coolant supplying device 55 that is a unitary construction of a coolant supplying portion 45, an air jet supplying portion 46 and an air jet recovering portion 47. The coolant supplying portion 45 consists of a coolant nozzle 48 and a coolant introducing path 49 mounted on a base 50 as a unit. The coolant nozzle 48 discharges coolant to at least one of the grinding point P and an outer peripheral surface of the workpiece W. The coolant introducing path 49 introduces coolant to the coolant nozzle 48. The air jet supplying portion 46 consists of an air jet nozzle 51 and an introducing path 52 of said pressurized air on the base 50 as a unit at a side of the one side surface Ga of the grinding wheel G. The air jet nozzle 51 blows air jet transversally from the one side surface Ga to the other side surface Gb along the grinding surface Gc of the grinding wheel G at the upper stream position of the wheel rotational direction from the grinding point P. The introducing path 52 introduces said high pressurized air to the air jet nozzle 51. The air jet recovering portion 47 consists of a recovering port member 53 and an air jet discharging path 54 mounted on a base 50 as a unit at a side of said one side surface Ga of the grinding wheel G at a side of the other side surface Gb of the grinding wheel G. The recovering port member 53 is opened to face to the air jet nozzle 51. The air jet discharging path 54 leads air jet 35 with mist of coolant introduced into the recovering port member 53. The above-constructed coolant supplying device 55 is fixed on an upper surface of the wheel guard 20 by securing the base 50 by a bolt, the coolant introducing path 49 is connected to the coolant supplying device 21, the pressurized air introducing path 52 is connected to the pressurized air source 34 through the switch valve 33, and the air jet discharging path 54 is connected to the absorbing equipment 38 through the separator 39. Besides, the coolant nozzle 48 can be pivoted on the base 50 for adjustment of a supplying angle to supply coolant to the grinding point P.

The operation of the third embodiment is described hereinafter. Coolant is introduced to the coolant nozzle 48 from the coolant introducing path 49 to be discharged to the grinding point P. Said pressurized air introduced to the air jet nozzle 51 by the pressurized air introducing path 52 is blown transversally from the one side surface Ga to the other side surface Gb along the grinding surface Gc of the grinding wheel G at the upper stream position of the wheel rotational direction from the grinding point P. Air jet 35 is collected with mist of coolant blown by air jet 35 to the recovering port member 53 opened to the air jet nozzle 51 at the other side surface Gb of the grinding wheel G and mist of coolant with air is led through the air jet discharging path 54 to the separator 39 to be separated from air outside. Since the coolant supplying portion 45, the air jet supplying portion 46 and the air jet recovering portion 47 are constructed as a unit, these three portions are maintained constantly at a suitable position so that it can be possible that supplying coolant and air jet and recovering them are performed correctly and constantly in a stable condition. Therefore, coolant flowing with the air layer 36 is prevented from being scattered from the wheel guard 20 to the atmosphere in the stage of mist.

Figure 12:
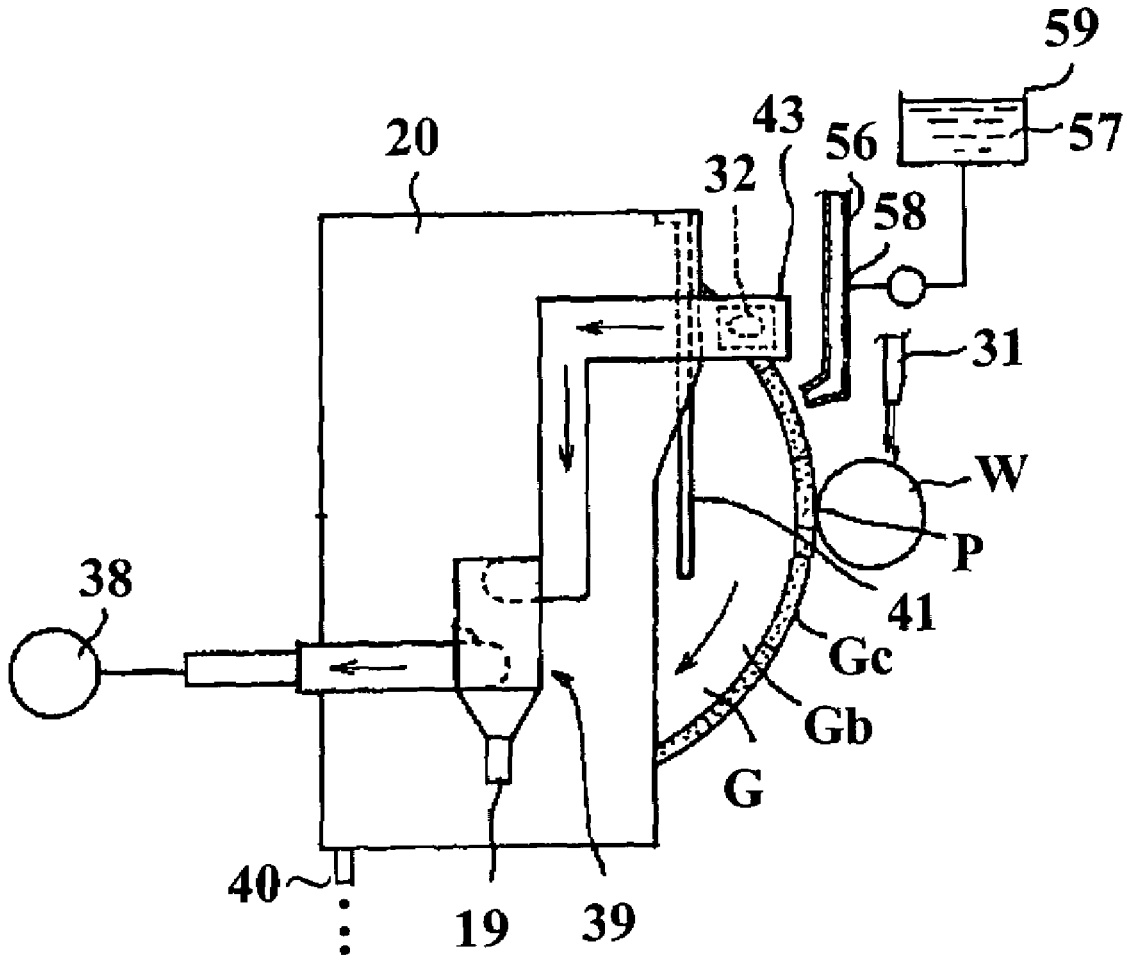
FIG. 12 is a side view of an air cut device to cut off air layer flowing on a circumferential surface of a grinding wheel in fourth embodiment of the present invention.

Next the fourth embodiment of the present invention will be now described hereinafter referring to FIG. 12. The same numeral of the fourth embodiment to the second embodiment of the present invention shows the same construction so that an explanation of the same numeral is omitted. Only a difference of the fourth embodiment from the second embodiment is an ecology grinding equipment. The coolant nozzle 31 is mounted on the wheel guard 20 to face to the workpiece W and the amount of coolant discharged from the coolant nozzle 31 is 0.1 to 0.5 l/minutes, almost 1/100 of a normal amount of coolant, for cooling the workpiece W. A compressed air nozzle 56 is opened to the circumferential surface Gc of the grinding wheel G at the upper stream of the rotational direction of the grinding wheel from the grinding point P. A nozzle 58 is mounted on the compressed air nozzle 56 to be connected to a lubrication tank 59 in order to drop lubrication oil 57. Lubrication oil 57 is dropped into the compressed air nozzle 56 to be atomized by air to be blown with the compressed air to the circumferential surface Gc of the grinding wheel G in order to lubricate the grinding wheel G at the grinding point P. The air jet nozzle 32 is mounted on the wheel guard 20 to blow air jet 35 transversally from said one side surface Ga to the other side surface Gb along the grinding surface Gc of the grinding wheel G at the upper stream position of the wheel rotational direction from a point where the atomized lubrication oil 57 is blown with said compressed air to the circumferential surface Gc. Air layer flowing on the circumferential surface Gc is cut off by air jet 35 so that the atomized lubrication oil is stuck with the circumferential surface Gc efficiently. Thereby, coolant flowing with air layer 36 is reliably prevented from being scattered from the wheel guard 20 to atmosphere in the stage of mist by the way of dramatically reducing a total volume of coolant to almost 1/100 of the conventional coolant volume with an assistance of lubrication oil.

While the invention has been described in detail with reference to the preferred embodiment, it will be apparent to those skilled in the art that the invention is not limited to the present embodiment, and that the invention may be realized in various other embodiments within the scope of the claims.

For example, the recovering port member 43 of the second embodiment can be installed in the first embodiment of the present invention and said collected mist of coolant can be collected from both of the recovering port 37 and 43 by the same absorbing equipment 38 through the same separator 39. Or also, the coolant supplying device 55 of the third embodiment can be installed in the first embodiment of the present invention and mist of coolant can be collected from both of the air jet discharging path 54 and the recovering port 37 by the same absorbing equipment 38 through the same separator 39. In the above-mentioned example the fourth embodiment is equipped in the second embodiment of the present invention, however, the fourth embodiment can be installed in the first embodiment or the third embodiment. In the entire above-mentioned embodiments air jet 35 is blown transversally from one side to the other side of the grinding wheel G along the circumferential surface Gc, it can be practiced that hydraulic jet of high pressurized coolant is blown transversally from one side to the other side of the grinding wheel G along the circumferential surface Gc in order to cut off air layer flowing on the circumferential surface Gc.

Furthermore, the technological components described in this specification and illustrated in the drawings can demonstrate their technological usefulness independently through various other combinations which are not limited to the combinations described in the claims made at the time of application. Moreover, the art described in this specification and illustrated in the drawings can simultaneously achieve a plurality of objectives, and is technologically useful by virtue of realizing any one of these objectives.

What is claimed is:

1. A method of grinding a workpiece with a grinding wheel having a circumferential surface by way of a relative movement between said grinding wheel rotatably supported on a wheel slide and said workpiece supported by a work support device, the method comprising:

cutting off an air layer flowing on the circumferential surface by blowing a hydraulic jet substantially parallel thereto at a position upstream of a grinding point with respect to direction of rotation of said grinding wheel; and collecting a mist of coolant blown by said hydraulic jet through a recovering port mounted on a wheel guard covering a part of said grinding wheel.

2. The grinding method according to claim 1, further comprising:

absorbing said mist of said coolant from said recovering port by an absorbing device;

separating said mist of coolant by a separator inserted between said recovering port and said absorbing device; and discharging a hydraulic coolant from a discharge port mounted on a lower portion of said wheel guard.

3. The grinding method according to claim 2, wherein said recovering port is formed on an upper back portion of said wheel guard.

4. The grinding method according to claim 2, wherein said recovering port is mounted on said wheel guard at a location substantially diametrically opposite to a location where said grinding wheel faces saidhydraulic jet.

5. A machine for grinding a workpiece with a grinding wheel having a circumferential surface by way of a relative movement between said grinding wheel rotatably supported on a wheel slide and said workpiece supported by a work support device, the grinding machine comprising:

a nozzle mounted on a wheel guard covering a part of said grinding wheel and configured to blow a hydraulic jet substantially parallel to the circumferential surface at a position upstream of a grinding point with respect to a direction of rotation of said grinding wheel to cut off an air layer flowing on said circumferential surface; and a recovering port mounted on said wheel guard configured to collect a mist of coolant blown by said hydraulic jet.

6. The grinding machine according to claim 5, further comprising:

an absorbing device connected to said recovering port;

a separator connected between said recovering port and said absorbing device configured to separate said mist of said coolant from said hydraulic jet; and a discharge port mounted on a lower portion of said wheel guard configured to discharge a hydraulic coolant from said wheel guard, wherein said hydraulic jet is an air jet.

7. The grinding machine according to claim 6, wherein said recovering port is formed on an upper back portion of said wheel guard.

8. The grinding machine according to claim 6, wherein said recovering port is mounted on said wheel guard at a location substantially diametrically opposite to a location where said grinding wheel faces said nozzle.

9. The grinding machine according to claim 5, further comprising:

a baffle plate mounted on said wheel guard facing said grinding wheel and separated therefrom by a small clearance at a position upstream of position of said hydraulic jet direction of said grinding wheel.

10. The grinding machine according to claim 9, wherein said wheel guard comprises a sealed construction, and only a front portion of said grinding wheel around said grinding point projects from said wheel guard through a slit formed in a front wall thereof.

11. The grinding machine according to claim 10, wherein said wheel guard comprises a guard body configured to shield a side surface of said grinding wheel of facing said wheel slide and a cover shielding an opened portion of said grinding wheel on the opposite side surface, and said slit is formed by a cooperation of a front wall of said guard body and a front wall of said cover when said cover is pivoted to close said opened portion.

12. The grinding machine according to claim 5, further comprising a unitary construction coolant supplying device, comprising:

a coolant supplying portion comprising a coolant nozzle configured to discharge said coolant to at least one of said grinding point and an outer peripheral surface of said workpiece, and a coolant introducing path configured to introduce said coolant to said coolant nozzle;

a hydraulic jet supplying portion comprising the nozzle, and a path configured to introduce said hydraulic jet to said nozzle; and a hydraulic jet recovering portion comprising a recovering port member facing said nozzle, and a hydraulic jet discharging path configured to lead said hydraulic jet and said mist of coolant outside.

13. A grinding machine according to claim 5, further comprising an ecology grinding equipment, comprising:

said coolant nozzle directly facing said workpiece, the coolant nozzle being configured to supply a small amount of said coolant to cool said workpiece;

a compressed air nozzle opened to said circumferential surface of said grinding wheel at the upstream position; and another nozzle mounted on said compressed air nozzle and connected to a lubrication tank, the another nozzle being configured to deliver lubrication oil to said compressed air nozzle in order to lubricate said grinding wheel at said grinding point.

* * * * *